US006998025B2

(12) United States Patent
Scherb

(10) Patent No.: US 6,998,025 B2
(45) Date of Patent: Feb. 14, 2006

(54) PRESS SHOE

(75) Inventor: Thomas Thoroe Scherb, Sao Paulo (BR)

(73) Assignee: Voith Paper Patent GmbH, Heidenheim (DE)

( * ) Notice: Subject to any disclaimer, the term of this patent is extended or adjusted under 35 U.S.C. 154(b) by 287 days.

(21) Appl. No.: 10/396,340

(22) Filed: Mar. 26, 2003

(65) Prior Publication Data

US 2003/0183359 A1 Oct. 2, 2003

(30) Foreign Application Priority Data

Mar. 27, 2002 (DE) ..... 102 13 852

(51) Int. Cl.
*D21F 3/06* (2006.01)

(52) U.S. Cl. ..... 162/358.3; 162/205

(58) Field of Classification Search ..... 162/203–207, 162/358.1, 358.3, 358.5, 359.1, 272, 361; 100/38, 153
See application file for complete search history.

(56) References Cited

U.S. PATENT DOCUMENTS

| | | | | |
|---|---|---|---|---|
| 4,425,190 A | | 1/1984 | Cronin | |
| 4,427,492 A | * | 1/1984 | Cronin | 162/358.3 |
| 4,428,797 A | | 1/1984 | Cronin | |
| 5,507,916 A | * | 4/1996 | Schiel | 162/195 |
| 5,711,854 A | * | 1/1998 | Schiel et al. | 162/358.3 |
| 6,306,261 B1 | | 10/2001 | Meschenmoser et al. | |
| 2002/0060046 A1 | | 5/2002 | Scherb et al. | |

FOREIGN PATENT DOCUMENTS

| | | | |
|---|---|---|---|
| DE | 3239954 | | 5/1984 |
| DE | 4401580 | | 6/1994 |
| DE | 19642049 | | 4/1998 |
| DE | 19642943 | | 4/1998 |
| DE | 10032251 | | 1/2002 |
| DE | 101 53 477 | * | 5/2002 |

* cited by examiner

*Primary Examiner*—Eric Hug
(74) *Attorney, Agent, or Firm*—Greenblum & Bernstein, P.L.C.

(57) ABSTRACT

Press shoe of a shoe press unit and a machine including press shoe. The press shoe includes at least two lateral edge areas, which are structured and arranged to be positioned adjacent web edges, and a central area lying between the at least two lateral edge areas. At least in some sections of the at least two lateral edge areas are structured to have a lower bending stiffness than in the central area. The instant abstract is neither intended to define the invention disclosed in this specification nor intended to limit the scope of the invention in any way.

51 Claims, 4 Drawing Sheets

PRESS SHOE

CROSS-REFERENCE TO RELATED APPLICATIONS

The present application claims priority under 35 U.S.C. §119 of German Patent Application No. 102 13 852.4, filed on Mar. 27, 2002, the disclosure of which is expressly incorporated by reference herein in its entirety.

BACKGROUND OF THE INVENTION

1. Field of the Invention

The present invention relates to a press shoe of a shoe press unit that, together with an opposing surface, forms a nip through which a material web, in particular a tissue web, to be formed or to be treated is guided. It further relates to a tissue machine with at least one such press shoe assigned to a drying cylinder, in particular a Yankee cylinder.

2. Discussion of Background Information

The press shoes hitherto usual have a constant thickness across the width crosswise to the web travel direction.

However, in particular with tissue machines with so-called Yankee drying cylinders, the problem occurs that the nip does not run straight across the width, but has to adapt to the contour of the jacket of the Yankee cylinder in order to achieve, e.g., constant solids content values for the tissue web across the width. The contour of a Yankee cylinder changes as a result of the steam pressure inside and as a result of a temperature expansion of the face cover. If a press shoe is now pressed against the Yankee cylinder to form a nip or press nip, the pressing pressure distribution resulting in the crosswise direction is no longer constant, but deviates upwards or downwards at the edges. The press shoe therefore has to be bent viewed across the width. Although the press shoe is relatively thin and thus features a relatively small moment of bending inertia compared to a suction contact roll, it opposes too great a resistance to a respective bending moment. As a result, the pressing pressure acting on the tissue web edges becomes greater than in the center of the web. In order to combat this problem, attempts have already been made to reduce the thickness of the press shoe evenly across the width, in order to obtain a smaller moment of bending inertia or moment of resistance. However, this measure does not lead to the desired result for production-oriented reasons. The problem could not be completely solved by a different contact pressing in the edge area either, since the contact pressure forces of adjacent contact pressure elements and accordingly the residual errors were too great.

SUMMARY OF THE INVENTION

The present invention provides a press shoe and a tissue machine of the type mentioned at the outset with which the above-mentioned problems are eliminated.

With regard to the instant invention, the press shoe has a lower bending stiffness in its two lateral edge areas adjacent to the web edges, at least in some sections, than in its central area lying between them. The respective lower bending stiffness can be thereby achieved, e.g., in that the press shoe has a lower thickness in the edge areas than in its area lying between them and/or the material of the press shoe is selected accordingly.

Thus, one basic concept of the invention is to reduce the bending stiffness in the edge area of the shoe in order to be able to adjust a desired pressing pressure distribution there.

In the case of a reduction of thickness the press shoe thickness is thus reduced, e.g., only in the edge areas.

According to a preferred practical embodiment of the press shoe according to the invention, a respective edge area of lower bending stiffness has a width measured crosswise to the machine travel direction of a maximum of approx. 1000 mm, in particular a maximum of approx. 700 mm and preferably a maximum of approx. 500 mm. The width of a respective edge area can extend, e.g., across two contact pressure elements, preferably across three contact pressure elements and in particular across four contact pressure elements.

In certain cases, it is advantageous if the thickness in a respective edge area becomes smaller and smaller towards the relevant shoe edge. The thickness in a respective edge area can thereby become, e.g., stepwise smaller towards the relevant shoe edge. The transition between the individual steps can occur, e.g., continuously. In principle, however, such an embodiment is also conceivable in which the thickness in a respective edge area becomes continuously or steadily smaller towards the relevant shoe edge.

In an expedient practical embodiment, the press shoe features a plurality of local material cutouts in a respective edge area. These can be formed in particular by notches or the like, which can extend at least partially in particular in the crosswise direction or in the web travel direction.

The material cutouts can be, e.g., the same size. The material cutouts can thus be formed, e.g., by notches of a constant depth.

However, in principle, the material cutouts can also be formed by notches of variable depth. Thus, for instance, such an embodiment is conceivable in which the notches extend at least partially in the crosswise direction and the notches respectively have a depth that increases towards a relevant shoe edge.

However, the material cutouts can also be different sizes at least in part. In this case they can be formed, e.g., by notches of different depths. Thus, for instance, the depth of notches extending in the crosswise direction can increase towards the relevant shoe edge.

The material cutouts formed, e.g., by notches can be arranged with the same distance or also with different distances from one another. In the latter case the material cutouts can be arranged, e.g., closer together towards the relevant shoe edge.

According to a preferred practical embodiment of the press shoe according to the invention, a corresponding reduction in thickness is provided only on the side of the press shoe facing away from the nip.

However, in certain cases, it can be advantageous if a reduction in thickness is provided respectively both on the side of the press shoe facing away from the nip and on the side of the press shoe facing the nip.

However, in principle such an embodiment is also conceivable in which a corresponding reduction in thickness is provided only on the side of the press shoe facing the nip.

As already mentioned, in particular a steady reduction in thickness towards the relevant shoe edge can also be provided in a respective edge area. However, e.g., a stepwise reduction in thickness is also conceivable.

The reduction in thickness provided in a respective edge area is preferably selected such that the bending stiffness of the press shoe decreases towards the relevant shoe edge.

The press shoe can be embodied as a single part or as multiple parts.

Alternatively or additionally the press shoe can also in particular be made of different materials. According to an expedient practical embodiment the press shoe can be made of, e.g., a more pliable material at least in part in the edge areas than in the central area.

The present invention is directed to a machine for producing a tissue web that includes a press shoe according to the invention which is assigned to a drying cylinder, e.g., a Yankee cylinder, to form a nip. The press shoe can be pressed against the drying cylinder via several contact pressure elements that are arranged in at least one row extending crosswise to the web travel direction.

In a preferred practical embodiment of the tissue machine according to the invention, at least the contact pressure elements assigned to the two edge areas of the press shoe can be acted upon or controlled separately at least in part.

The present invention is directed to a press shoe of a shoe press unit. The press shoe includes at least two lateral edge areas, which are structured and arranged to be positioned adjacent web edges, and a central area lying between the at least two lateral edge areas. At least in some sections of the at least two lateral edge areas are structured to have a lower bending stiffness than in the central area.

According to a feature of the present invention, a thickness in the at least two lateral edge areas is smaller than a thickness in the central area.

In accordance with another feature of the invention, a material of the at least two lateral edge areas has a lower bending stiffness than a material of the central area.

Further, at least one of the at least two lateral edge areas has a width, measured crosswise to a machine travel direction, of a maximum of about 1000 mm. The width of the at least one lateral edge area may be a maximum of about 700 mm, and the width of the at least one lateral edge area can be a maximum of about 500 mm.

The press shoe further includes a plurality of contact pressure elements, and the plurality of pressure contact elements are arranged to that at least two of the plurality of contact elements are arranged to support a width of at least one of the at least two lateral edge areas. At least three of the plurality of contact elements are arranged to support the width of the at least one lateral edge area.

According to still another feature of the instant invention, a thickness in at least one of the at least two lateral edge areas decreases towards an edge of the at least one lateral edge area. Further, a thickness in at least one of the at least two lateral edge areas decreases in a stepwise manner toward an edge of the at least one lateral edge area. A continuous transition can be provided between adjacent steps, and the thickness in the at least one lateral edge area can continuously or steadily decrease toward the edge of the at least one lateral edge area.

In accordance with the invention, at least one of the at least two lateral edge can include a plurality of local material cutouts. The material cutouts can be formed by notches, and the notches may be arranged to extend at least in part crosswise to a machine direction and/or the notches can be arranged to extend at least in part in a machine direction. The material cutouts can be a same size. Further, the material cutouts may be formed by notches having a constant depth and/or the material cutouts are formed by notches having varied depths. The notches may be arranged to extend at least in part crosswise to a machine direction and the notches have an increasing depth toward an edge of the at least one lateral edge area. Moreover, the material cutouts can at least in part be different sizes. The material cutouts can be formed by notches having differing depths, and the differing depths of the notches can be arranged to increase toward the edge of the at least one lateral edge area. The material cutouts may be arranged at a same distance from one another and/or the material cutouts located closer to the edge of the at least one lateral edge area may be positioned closer together than the material cutouts located further away from the edges.

According to another feature of the invention, the at least two lateral edge areas can have a reduced thickness only on a side of the press shoe structured to face away from a nip.

The at least two lateral edge areas have a reduced thickness on a side of the press shoe structured to face away from a nip and on a side of the press shoe structured to face the nip.

Moreover, the at least two lateral edge areas can have a reduced thickness only on a side of the press shoe structured to face a nip.

A thickness in at least one of the at least two lateral edge areas may steadily decrease toward an edge of the at least one lateral edge.

In accordance with a further feature, a thickness in at least one of the at least two lateral edge areas may decrease toward an edges of the at least two lateral edge areas to decrease the bending stiffness of the at least two lateral edge areas toward the edges.

Further, the press shoe can be formed as a single element, or the press shoe may be formed in multiple parts.

Still further, the press shoe may be composed of different materials.

According to another feature, at least a part of the at least two lateral edge areas can be made of a material more pliable than a material forming the central area.

The present invention is directed to a shoe press unit comprising the press shoe defined above and further includes an opposing surface arranged with the press shoe to form a nip. The nip is structured and arranged to treat a material web passing through the nip. The material web can include a tissue web.

The instant invention is directed to a machine for producing a tissue web that includes a press shoe as defined above, and further includes a drying cylinder arranged with the press shoe to form a nip, and a plurality of contact pressure elements arranged crosswise to a machine direction to press the press shoe against the drying cylinder.

According to another feature of the invention, the plurality of contact pressure elements can be arranged in at least one row.

Further, the drying cylinder can include a Yankee cylinder.

At least some of the plurality of contact pressure elements can be arranged to support the at least two lateral edge areas, and at least the some contact pressure elements are at least in part separately controlled or acted upon.

The present invention is directed to a process of forming a press shoe of a shoe press unit. The process includes forming at least two lateral edge areas and a central area lying between the at least two lateral edge areas, and reducing a bending stiffness at least in some sections of the at least two lateral edge areas relative to a bending stiffness in the central area.

According to a feature of the invention, the reducing of the bending stiffness can include decreasing a thickness in the at least two lateral edge areas to be smaller than a thickness of the central area.

In accordance with another feature of the present invention, the reducing of the bending stiffness may include forming the at least two lateral edge areas with a material having a lower bending stiffness than a material forming the central area.

Further, the reducing of the bending stiffness can include decreasing a thickness in at least one of the at least two lateral edge areas towards an edge of the at least one lateral edge area.

Moreover, the reducing of the bending stiffness can include decreasing a thickness in at least one of the at least two lateral edge areas in a stepwise manner toward an edge of the at least one lateral edge area.

The reducing of the bending stiffness can include continuously or steadily decreasing a thickness in at least one of the at least two lateral edge areas toward an edge of the at least one lateral edge area.

In accordance with still yet another feature of the present invention, the reducing of the bending stiffness can include forming a plurality of local material cutouts in at least one of the at least two lateral edge areas. The material cutouts can be formed by notches, and notches can be arranged to extend at least in part crosswise to a machine direction and/or to extend at least in part in a machine direction. The material cutouts located closer to the edge of the at least one lateral edge area can be positioned closer together than the material cutouts located further away from the edges.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
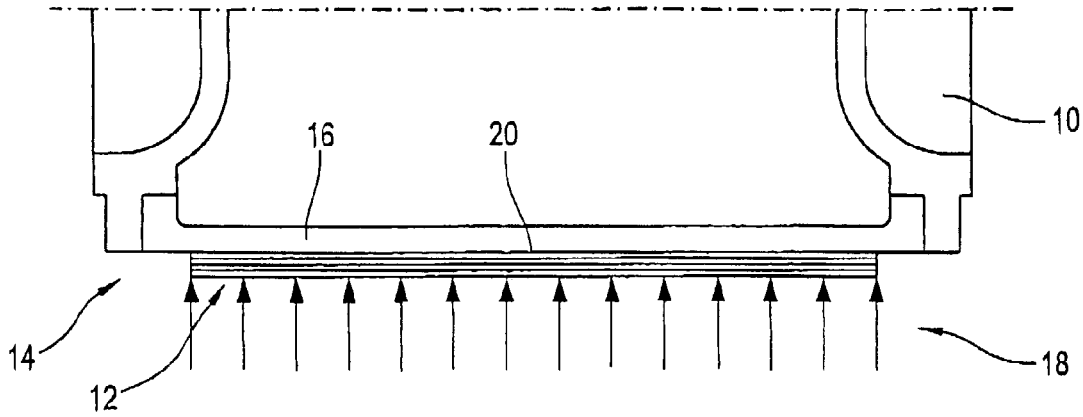
FIG. 1 diagrammatically illustrates a longitudinal sectional view of a shoe press in an unloaded condition with a Yankee cylinder.

FIG. 1 shows in a diagrammatic longitudinal sectional representation a shoe press 14 comprising a drying cylinder 10, in particular a Yankee cylinder, which is assigned a conventional press shoe 12 in unloaded condition. Jacket 16 of drying cylinder 10 is therefore not bent in the present (unloaded) case.

Press shoe 12 is pressed against drying cylinder 10 by at least one row of contact pressure elements 18. With drying cylinder 16, press shoe 12 forms a nip 20 through which the tissue web is guided together with at least one carrier belt (not shown). The tissue web preferably runs through press nip or nip 20 with a water-impervious press jacket and a felt (water-absorbing).

Figure 2:
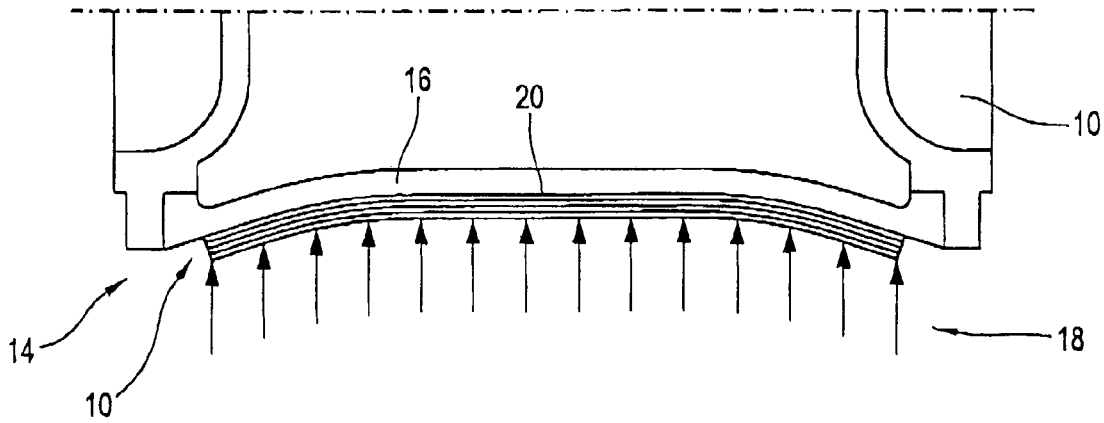
FIG. 2 diagrammatically illustrates a longitudinal sectional view of the shoe press in an operating condition with the Yankee cylinder.

FIG. 2 shows a representation comparable with that of FIG. 1, except that shoe press 14 is in a loaded condition, i.e., in an operating condition. In the operating condition the contour of drying cylinder 10 is deformed by the cylinder interior pressure (steam) and a greater expansion of the face cover of the drying cylinder as a result of the steam temperature and through other construction-related factors. Furthermore, the contour of drying or Yankee cylinder 10 in particular in the area of nip 20 is influenced by different pressing pressures or linear loads. Jacket 16 of drying cylinder 22 is therefore bent here. As can be seen from FIG. 2, a corresponding sagging also results with press shoe 12.

Conventional press shoe 12, depicted in FIGS. 1 and 2, has a constant thickness across its width, i.e., crosswise to the machine direction.

Figure 3:
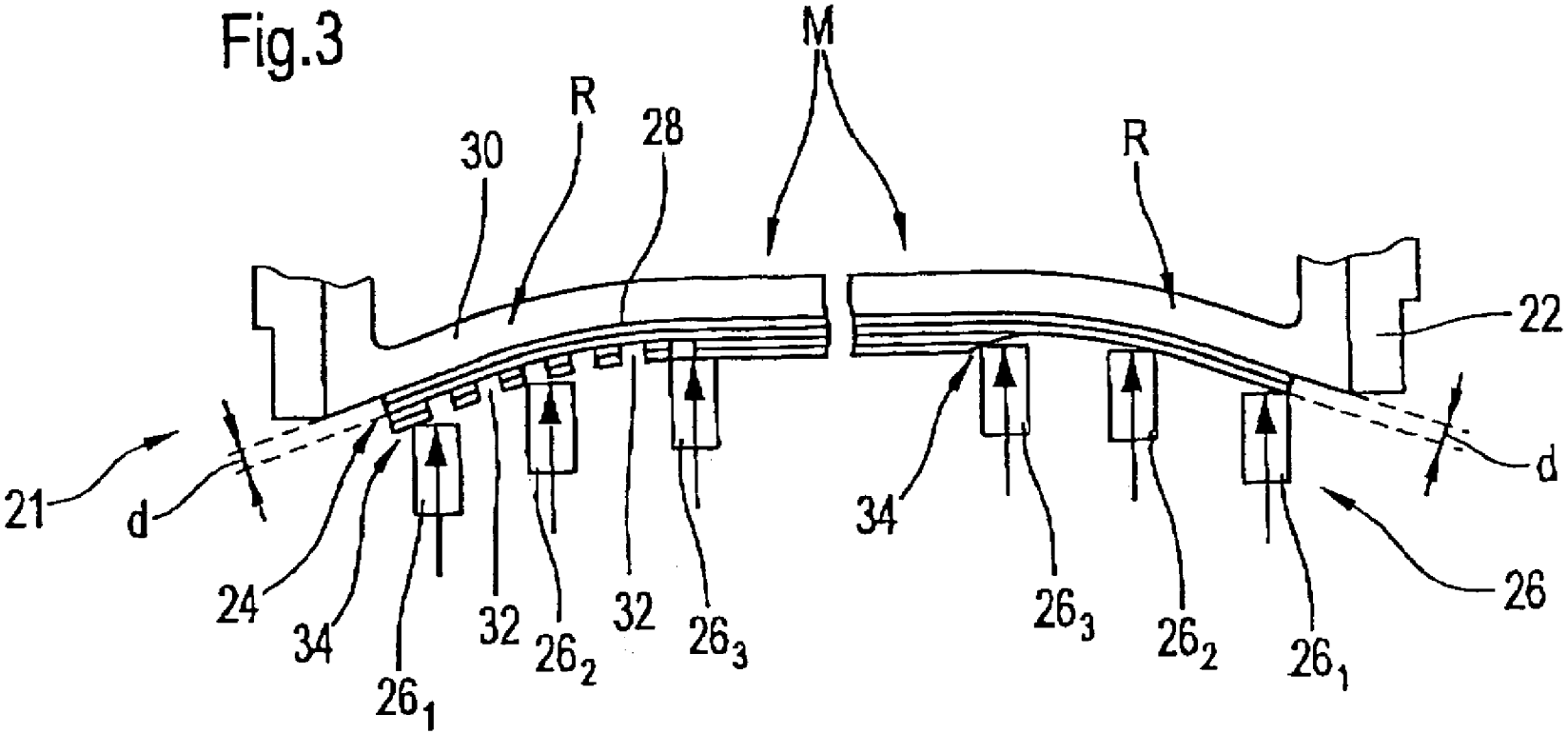
FIG. 3 diagrammatically illustrates a longitudinal sectional view of a shoe press according to the invention in an operating condition with the Yankee cylinder.

FIG. 3 shows, in a diagrammatic longitudinal sectional representation, a shoe press 21 according to the invention formed by a drying cylinder 22, e.g., a Yankee cylinder, and a press shoe 24 according to the invention. Further, a plurality of contact pressure elements 26, arranged, e.g., in at least one row extending crosswise to the web travel direction, can pressed press shoe 24 against drying cylinder 22. Press shoe 24 can be embodied or formed as a single part or as multiple parts. In FIG. 3, shoe press 22 is shown in operating condition.

With drying cylinder 22, press shoe 24 forms a nip 28 through which the tissue web is guided together with at least one carrier belt (not shown). The tissue web preferably runs through press nip or nip 28 again together with a water-impervious press jacket and a felt (water-absorbing).

Jacket 30 of drying cylinder 22 is bent, as shown in an exemplary fashion, during operating condition. As can be seen from FIG. 3, a corresponding sagging also results with press shoe 24.

In the present case, several, e.g., three contact pressure elements $\mathbf{26}_1$–$\mathbf{26}_3$, are respectively assigned to the two lateral edge areas R of press shoe 24. Contact pressure elements $\mathbf{26}_Z$ can be assigned to a central area (see FIGS. 4 and 6).

As can be seen from FIG. 3, press shoe 24 has a smaller thickness d in its two lateral edge areas R adjacent to the web edges, at least in some sections, than in its central area M lying between them.

As can be seen from the left hand side of FIG. 3, material cutouts in the form of notches 32 or the like can be provided to form a corresponding reduction in thickness 34, e.g., on a side of press shoe 24 facing away from nip 28, which cutouts extend, e.g., in the web travel direction in the present case.

As can be seen from the right hand side of FIG. 3, an at least essentially continuous reduction in thickness 34 can also be provided in a respective edge area R. This reduction in thickness 34 is also provided on, e.g., a side of press shoe 24 facing away from nip 28. As FIG. 3 shows, the transition from the central area M to the edge area R of reduced thickness can be, e.g., continuous.

At least contact pressure elements 26 assigned to the two edge areas R of press shoe 24 can be acted on or controlled at least in part separately. Contact pressure elements $\mathbf{26}_1$–$\mathbf{26}_3$, e.g., hydraulic contact pressure elements, can, in particular, be acted upon with different pressures, through which correspondingly different contact pressures are produced. Contact pressure elements 26 can thereby be acted upon and/or controlled such that an at least essentially uniform pressing pressure cross profile or linear load profile results in nip 28. In principle, corresponding contact pressure elements $\mathbf{26}_Z$ (see FIGS. 4 and 5) can also be assigned to central area M. Central contact pressure elements $\mathbf{26}_Z$ can also in principle be acted upon or controlled at least in part separately.

A respective edge area R of smaller thickness d can have a width measured crosswise to a machine travel direction of, e.g., a maximum of approx. 1000 mm, in particular a maximum of approx. 700 mm and preferably a maximum of approx. 500 mm.

Figure 4:
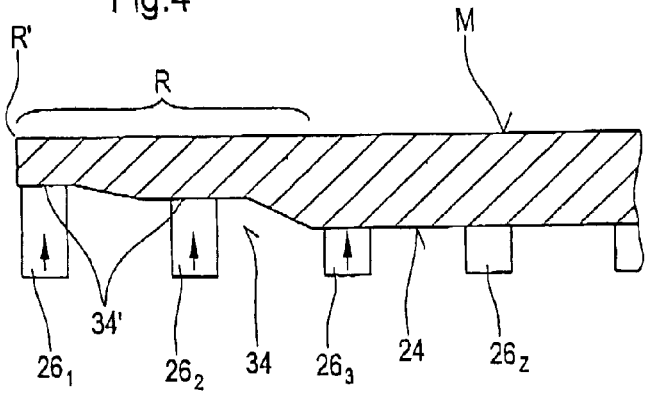
FIG. 4 diagrammatically illustrates a partial view of another embodiment of the press shoe according to the invention, in which a corresponding reduction in thickness is provided only on the side of the press shoe facing away from the nip and the thickness in a respective edge area becomes stepwise smaller towards the relevant shoe edge.

FIG. 4 shows in diagrammatic partial representation another embodiment of press shoe 24 according to the invention, in which a corresponding reduction in thickness 34 is provided only on a side facing away from the nip. In the exemplary case, the thickness in a respective edge area R is reduced stepwise towards respective shoe edge R'. Between individual steps 34', as shown, e.g., a continuous transition can thereby result.

In particular contact pressure elements $\mathbf{26}_1$, $\mathbf{26}_2$ that can be acted upon or controlled separately can be assigned to an edge area R with a respectively reduced thickness. In the present case, e.g., two such contact pressure elements $\mathbf{26}_1$, $\mathbf{26}_2$ are assigned to a respective edge area R. Central area M of the press shoe can be acted upon via contact pressure elements $\mathbf{26}_Z$ that likewise can be acted upon or controlled at least in part separately.

Figure 5:
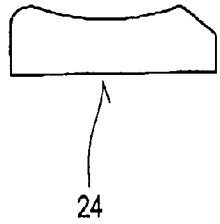
FIG. 5 diagrammatically illustrates a face view of the press shoe depicted in FIG. 4.

FIG. 5 shows a diagrammatic face view of the press shoe 24 according to FIG. 4.

Figure 6:
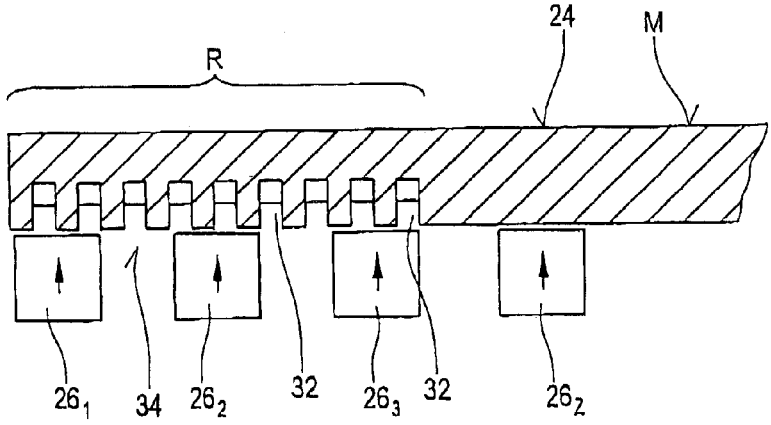
FIG. 6 diagrammatically illustrates a partial view of another embodiment of the press shoe according to the invention, in which a plurality of notches extending in the web travel direction is provided in a respective edge area of the press shoe on the side facing away from the nip.

FIG. 6 shows in diagrammatic partial representation another embodiment of press shoe 24 according to the invention, in which a respective reduction in thickness 34 is provided only on the side facing away from the nip. In the present case, several notches 32 are formed to extend, e.g., in the web travel direction, in a respective edge area R. In particular, several contact pressure elements $\mathbf{26}_1$–$\mathbf{26}_3$, that can preferably be acted upon or controlled separately at least in part, are respectively assigned to edge areas R. Central area M is also acted upon by corresponding contact pressure elements $\mathbf{26}_Z$.

Figure 7:
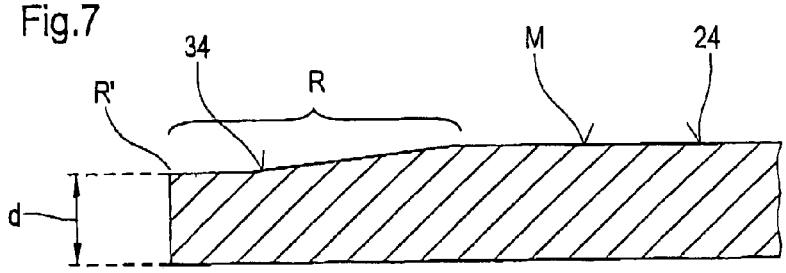
FIG. 7 diagrammatically illustrates a partial view of another embodiment of the press shoe according to the invention, in which a steady reduction in thickness towards the respective shoe edge is provided in a respective edge area of the press shoe on the side facing the nip.

FIG. 7 shows in diagrammatic partial representation another embodiment of press shoe 24 according to the invention, whereby a corresponding reduction in thickness 34 is provided on a side of press shoe 24 facing the nip. Thickness d of press shoe 24 thereby becomes smaller and smaller in a respective edge area R towards relative shoe edge R'.

Also in the present case, contact pressure elements (not shown) that can be acted upon or controlled preferably separately can be assigned to edge areas R.

Figure 8:
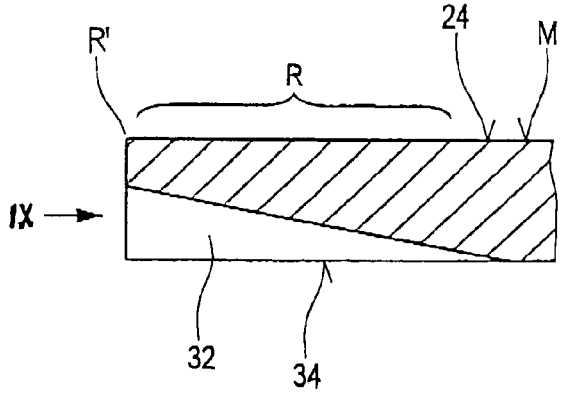
FIG. 8 diagrammatically illustrates a partial view of another embodiment of the press shoe according to the invention, in which notches extending in the crosswise direction are provided in a respective edge area of the press shoe on the side facing away from the nip, the depth of which notches increases towards the respective shoe edge.

FIG. 8 shows, in diagrammatic partial representation, another embodiment of press shoe 24 according to the invention in which a relevant reduction in thickness 34 is provided in edge areas R, on a side of press shoe 24 facing away from the nip. In this case, notches 34 extending in the crosswise direction are provided with a depth that increases toward respective shoe edge R'.

Figure 9:
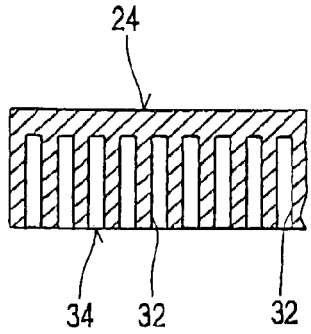
FIG. 9 diagrammatically illustrates a face view of the press shoe depicted in FIG. 8 in a direction of arrow "IX" of FIG. 8.

FIG. 9 shows a diagrammatic face view of a part of the press shoe 24 according to FIG. 8 in the direction of the arrow "IX" of FIG. 8.

Figure 10:
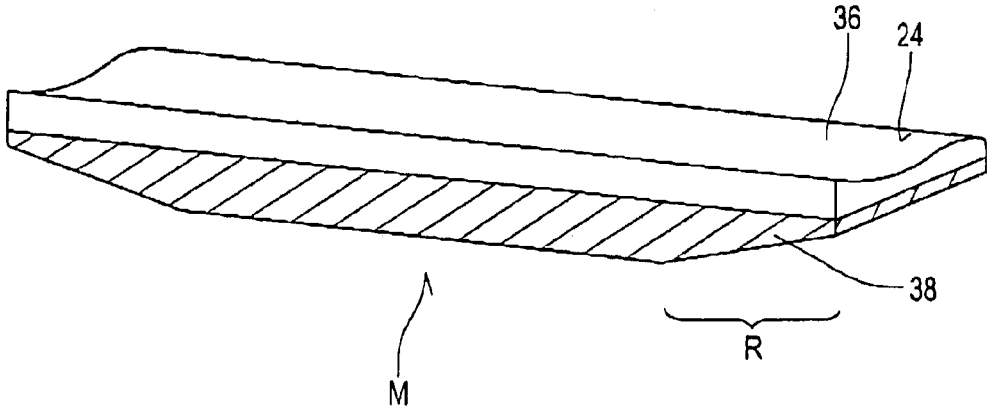
FIG. 10 diagrammatically illustrates a partial view of another embodiment of the press shoe according to the invention, in which the press shoe is made of different materials.

FIG. 10 shows, in diagrammatic partial view, another embodiment of press shoe 24 according to the invention. In this manner, press shoe 24 is made of different materials. For example, it is possible for press shoe 24 to be made partially or entirely of a more pliable material in edge area R than in central area M.

As can be seen from FIG. 10, press shoe 24 can be made, e.g., of a first material 36, e.g., brass or the like, and a bearing material 38, e.g., fiber-reinforced plastic or the like. In the present exemplary embodiment the bearing material in edge area R has a reduced thickness.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

10 Drying cylinder, Yankee cylinder
12 Press shoe
14 Shoe press
16 Jacket
18 Contact pressure element
20 Press nip, nip
21 Shoe press
24 Press shoe
26 Contact pressure element

28 Press nip, nip
30 Jacket
32 Material cutout, notch
34 Reduction in thickness
34' Step
36 Material
38 Bearing material
M Central area
R Edge area
R' Shoe edge
d Thickness

What is claimed:

1. A press shoe of a shoe press unit, comprising:

at least two lateral edge areas, which are structured and arranged to be positioned adjacent web edges; and a central area lying between said at least two lateral edge areas, wherein at least in some sections of said at least two lateral edge areas are structured to have a lower bending stiffness than in said central area.

2. The press shoe in accordance with claim 1, wherein a thickness in said at least two lateral edge areas is smaller than a thickness in said central area.

3. The press shoe in accordance with claim 1, wherein a material of said at least two lateral edge areas has a lower bending stiffness than a material of said central area.

4. The press shoe in accordance with claim 1, wherein at least one of said at least two lateral edge areas has a width, measured crosswise to a machine travel direction, of a maximum of about 1000 mm.

5. The press shoe in accordance with claim 4, wherein said width of said at least one lateral edge area is a maximum of about 700 mm.

6. The press shoe in accordance with claim 4, wherein said width of said at least one lateral edge area is a maximum of about 500 mm.

7. The press shoe in accordance with claim 1, further comprising a plurality of contact pressure elements, and said plurality of pressure contact elements are arranged to that at least two of said plurality of contact elements are arranged to support a width of at least one of said at least two lateral edge areas.

8. The press shoe in accordance with claim 7, wherein at least three of said plurality of contact elements are arranged to support said width of said at least one lateral edge area.

9. The press shoe in accordance with claim 1, wherein a thickness in at least one of said at least two lateral edge areas decreases towards an edge of said at least one lateral edge area.

10. The press shoe in accordance with claim 9, wherein a thickness in at least one of said at least two lateral edge areas decreases in a stepwise manner toward an edge of said at least one lateral edge area.

11. The press shoe in accordance with claim 10, wherein a continuous transition is provided between adjacent steps.

12. The press shoe in accordance with claim 9, wherein said thickness in said at least one lateral edge area continuously or steadily decreases toward said edge of said at least one lateral edge area.

13. The press shoe in accordance with claim 1, wherein at least one of said at least two lateral edge areas comprises a plurality of local material cutouts.

14. The press shoe in accordance with claim 13, wherein said material cutouts are formed by notches.

15. The press shoe in accordance with claim 14, wherein said notches are arranged to extend at least in part crosswise to a machine direction.

16. The press shoe in accordance with claim 14, wherein said notches are arranged to extend at least in part in a machine direction.

17. The press shoe in accordance with claim 13, wherein said material cutouts are a same size.

18. The press shoe in accordance with claim 13, wherein said material cutouts are formed by notches having a constant depth.

19. The press shoe in accordance with claim 13, wherein said material cutouts are formed by notches having varied depths.

20. The press shoe in accordance with claim 19, wherein said notches are arranged to extend at least in part crosswise to a machine direction and said notches have an increasing depth toward an edge of said at least one lateral edge area.

21. The press shoe in accordance with claim 13, wherein said material cutouts are at least in part different sizes.

22. The press shoe in accordance with claim 13, wherein said material cutouts are formed by notches having differing depths.

23. The press shoe in accordance with claim 22, wherein said differing depths of said notches are arranged to increase toward said edge of said at least one lateral edge area.

24. The press shoe in accordance with claim 13, wherein said material cutouts are arranged at a same distance from one another.

25. The press shoe in accordance with claim 13, wherein said material cutouts located closer to said edge of said at least one lateral edge area positioned closer together than said material cutouts located further away from said edges.

26. The press shoe in accordance with claim 1, wherein said at least two lateral edge areas have a reduced thickness only on a side of said press shoe structured to face away from a nip.

27. The press shoe in accordance with claim 1, wherein said at least two lateral edge areas have a reduced thickness on a side of said press shoe structured to face away from a nip and on a side of said press shoe structured to face the nip.

28. The press shoe in accordance with claim 1, wherein said at least two lateral edge areas have a reduced thickness only on a side of said press shoe structured to face a nip.

29. The press shoe in accordance with claim 1, wherein a thickness in at least one of said at least two lateral edge areas steadily decreases toward an edge of said at least one lateral edge.

30. The press shoe in accordance with claim 1, wherein a thickness in at least one of said at least two lateral edge areas decreases toward an edges of said at least two lateral edge areas to decrease said bending stiffness of said at least two lateral edge areas toward said edges.

31. The press shoe in accordance with claim 1, wherein said press shoe is formed as a single element.

32. The press shoe in accordance with claim 1, wherein said press shoe is formed in multiple parts.

33. The press shoe in accordance with claim 1, wherein said press shoe is composed of different materials.

34. The press shoe in accordance with claim 1, wherein at least a part of said at least two lateral edge areas is made of a material more pliable than a material forming said central area.

35. A shoe press unit comprising the press shoe according to claim 1 and further comprising:

an opposing surface arranged with said press shoe to form a nip, said nip being structured and arranged to treat a material web passing through said nip.

36. The shoe press unit in accordance with claim 35, wherein the material web comprises a tissue web.

37. A machine for producing a tissue web comprising a press shoe in accordance with claim 1 and further comprising:

a drying cylinder arranged with said press shoe to form a nip;

a plurality of contact pressure elements arranged crosswise to a machine direction to press said press shoe against said drying cylinder.

38. The machine in accordance with claim 37, wherein said plurality of contact pressure elements are arranged in at least one row.

39. The machine in accordance with claim 37, wherein said drying cylinder comprises a Yankee cylinder.

40. The machine in accordance with claim 37, wherein at least some of said plurality of contact pressure elements are arranged to support said at least two lateral edge areas, and at least said some contact pressure elements are at least in part separately controlled or acted upon.

41. A process of forming a press shoe of a shoe press unit, said process comprising:

forming at least two lateral edge areas and a central area lying between the at least two lateral edge areas; and reducing a bending stiffness at least in some sections of the at least two lateral edge areas relative to a bending stiffness in the central area.

42. The process in accordance with claim 41, wherein the reducing of the bending stiffness comprises decreasing a thickness in the at least two lateral edge areas to be smaller than a thickness of the central area.

43. The process in accordance with claim 41, wherein the reducing of the bending stiffness comprises forming the at least two lateral edge areas with a material having a lower bending stiffness than a material forming the central area.

44. The process in accordance with claim 41, wherein the reducing of the bending stiffness comprises decreasing a thickness in at least one of the at least two lateral edge areas towards an edge of the at least one lateral edge area.

45. The process in accordance with claim 41, wherein the reducing of the bending stiffness comprises decreasing a thickness in at least one of the at least two lateral edge areas in a stepwise manner toward an edge of the at least one lateral edge area.

46. The process in accordance with claim 41, wherein the reducing of the bending stiffness comprises continuously or steadily decreasing a thickness in at least one of said at least two lateral edge areas toward an edge of the at least one lateral edge area.

47. The process in accordance with claim 41, wherein the reducing of the bending stiffness comprises forming a plurality of local material cutouts in at least one of the at least two lateral edge areas.

48. The process in accordance with claim 47, wherein the material cutouts are formed by notches.

49. The process in accordance with claim 48, wherein the notches are arranged to extend at least in part crosswise to a machine direction.

50. The process in accordance with claim 48, wherein the notches are arranged to extend at least in part in a machine direction.

51. The process in accordance with claim 48, wherein the material cutouts located closer to the edge of the at least one lateral edge area positioned closer together than the material cutouts located further away from the edges.

* * * * *